US006336381B2

(12) United States Patent
McDonnell

(10) Patent No.: US 6,336,381 B2
(45) Date of Patent: Jan. 8, 2002

(54) POWERED PIPE WRENCH

(76) Inventor: Robert L. McDonnell, 2701 Mesquite Rd., Palm Springs, CA (US) 92264

( * ) Notice: Subject to any disclaimer, the term of this patent is extended or adjusted under 35 U.S.C. 154(b) by 0 days.

(21) Appl. No.: 09/729,864

(22) Filed: Dec. 6, 2000

Related U.S. Application Data

(63) Continuation-in-part of application No. 09/325,767, filed on Jun. 4, 1999, now abandoned.

(51) Int. Cl.[7] ..... B25B 17/00
(52) U.S. Cl. ..... 81/57.33; 81/57.12; 81/57.13
(58) Field of Search ..... 81/57.33, 57.12, 81/57.13, 57.11

(56) References Cited

U.S. PATENT DOCUMENTS

| | | | | |
|---|---|---|---|---|
| 1,505,205 A | | 8/1924 | Kilgour, Jr. | |
| 1,690,007 A | | 10/1928 | Greve | |
| 2,552,521 A | | 5/1951 | Coshow | |
| 3,521,509 A | | 7/1970 | Duke et al. | |
| 3,774,481 A | * | 11/1973 | Goodman | 81/57.13 |
| 4,103,419 A | | 8/1978 | Matthews et al. | |
| 4,178,817 A | * | 12/1979 | Gibson | 81/57.13 |
| 4,771,661 A | | 9/1988 | Levchenko et al. | |
| D306,392 S | | 3/1990 | Honeycutt | |
| 5,345,682 A | | 9/1994 | Dubinsky et al. | |
| 5,351,582 A | | 10/1994 | Snyder et al. | |
| 5,660,087 A | | 8/1997 | Rae | |
| 5,903,980 A | | 5/1999 | Collier et al. | |
| 6,065,372 A | * | 5/2000 | Ranch | 81/57.33 |

* cited by examiner

*Primary Examiner*—Joseph J. Hail, III
*Assistant Examiner*—Lee Wilson
(74) *Attorney, Agent, or Firm*—Dennison, Scheiner & Schultz

(57) ABSTRACT

A pipe wrench is provided having a elongated housing, a motor disposed within the housing, and a pipe attachment structure connected to the housing. A rotatable shaft extends from within the housing, transverse to the axis of the housing, and is rotated by the motor. A pair of drive rollers are mounted on the shaft. The pipe wrench further includes a support structure on the housing, a curved retaining arm pivotally mounted on the support structure, and a plurality of free-spinning rollers mounted on the retaining arm. In use, a pipe is placed within the retaining arm in contact with the free-spinning rollers and the handle is moved to bring the drive rollers into contact with the pipe. The motor causes the shaft to rotate which then rotates the pipe.

11 Claims, 5 Drawing Sheets

POWERED PIPE WRENCH

CROSS REFERENCE TO RELATED APPLICATIONS

This application is continuation-in-part of U.S. application Ser. No. 09/325,767, filed Jun. 4, 1999 now abandoned.

TECHNICAL FIELD

The present invention relates generally to a hand tool for rotating and installing pipes, and more particularly, to a powered pipe wrench.

BACKGROUND OF THE INVENTION

Both powered and manually operated pipe wrenches for assembling and disassembling lengths of threaded pipe have long been known. Manual pipe wrenches include a jaw portion that can be tightened about a section of pipe and a handle that is used to rotate the pipe. Powered pipe wrenches generally include a chain or similar flexible element that wraps around the pipe, a mechanism for tightening the chain about the pipe, rollers for engaging the sidewall of the pipe, and a drive mechanism for moving the chain or rollers to rotate the pipe while the handle of the wrench is held in one position.

A relatively large amount of force is required to keep a wrench in position on a pipe when the pipe is turned, and it is often difficult to hold a pipe tightly enough to prevent such relative motion.

While some prior art devices for rotating a pipe adequately prevent relative movement between the pipe and the wrench, these devices, especially powered pipe wrenches, can be cumbersome and require considerable labor and time to attach securely to the pipe. Therefore, there is a need for a powered pipe wrench that can quickly and effectively be secured into a use position to grip a pipe or similar object.

SUMMARY OF THE INVENTION

These problems and others are addressed by the present invention which comprises a pipe wrench having an elongated housing, a motor disposed within the housing, and a pipe attachment structure connected to the housing. A rotatable shaft extends from within the housing, transverse to the axis of the housing, and is rotated by the motor. A pair of drive rollers are mounted on the shaft. In a preferred embodiment, the pipe wrench further comprises a support structure on the housing, a curved retaining arm pivotally mounted on the support structure, and a plurality of free-spinning rollers mounted on the retaining arm. In use, a pipe is placed within the retaining arm in contact with the free-spinning rollers and the handle is moved to bring the drive rollers into contact with the pipe. The motor is then engaged to rotate the drive rollers and rotate the pipe while it is held securely between the drive rollers and the free-spinning rollers on the support structure.

It is therefore a primary object of the present invention to provide an improved powered pipe wrench that is simple and easy to use.

It is a further object of the present invention to provide a powered pipe wrench that is adjustable to fit pipes of various sizes.

It is another object of the present invention to provide a powered pipe wrench having removable drive rollers that can be replaced with rollers suited for use with a particular type of pipe.

It is still another object of the invention to provide a powered pipe wrench having exteriorly mounted rollers that are easy to clean and that are not prone to jamming.

It is still a further object of the present invention to provide a powered pipe wrench with a mechanism for limiting the torque imparted by the wrench to a preset level.

BRIEF DESCRIPTION OF DRAWINGS

These and other objects of the present invention will be appreciated and understood by those skilled in the art after reading the detailed description of the preferred embodiments of the invention together with the following drawings wherein.

DETAILED DESCRIPTION OF THE INVENTION

Figure 1:
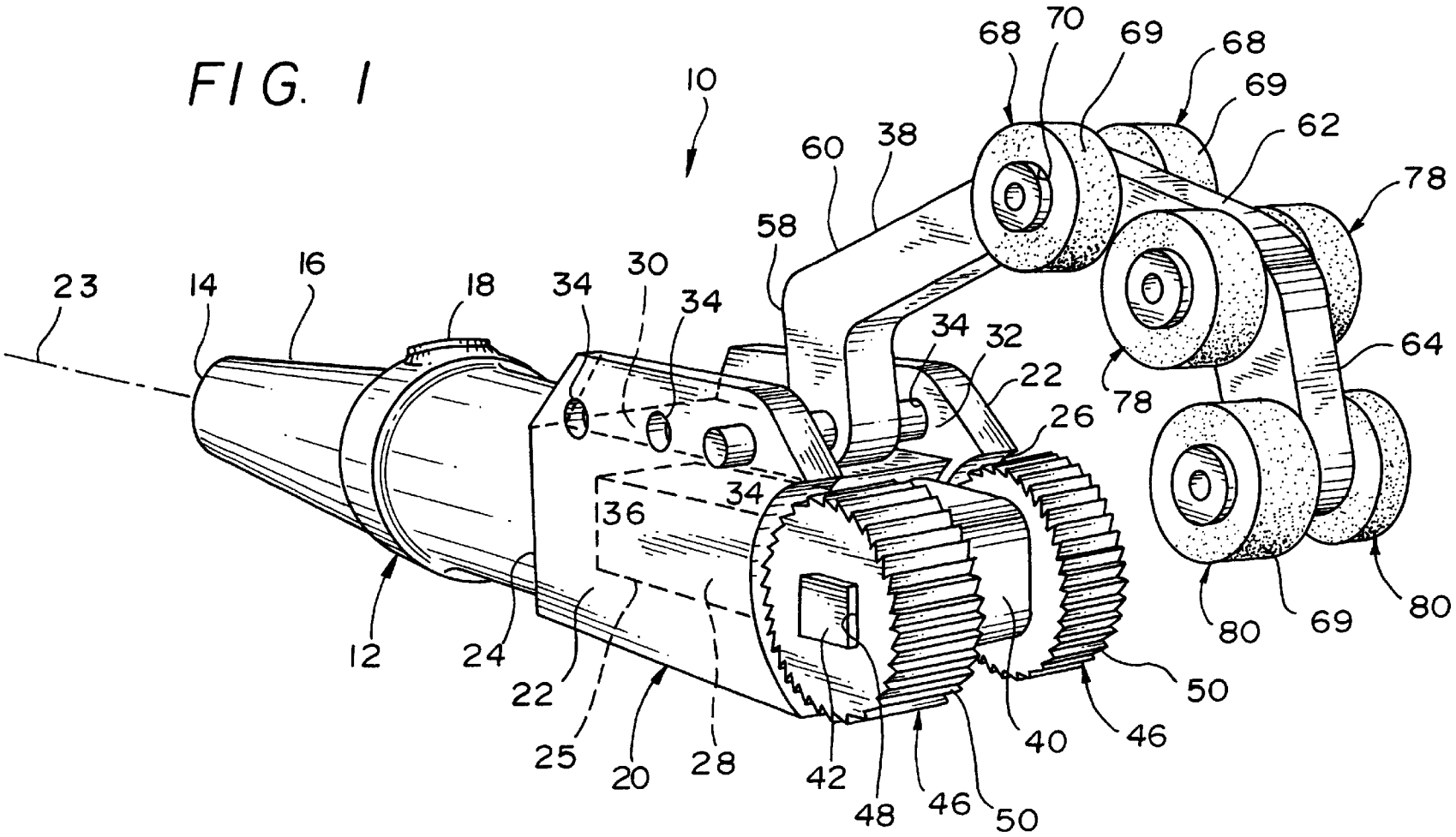
FIG. 1 is a perspective view of a pipe wrench according to the present invention.

Referring now to the drawings, wherein the showings are for the purpose of illustrating several embodiments of the invention only and not for the purpose of limiting same, FIG. 1 shows a pipe wrench 10 including an elongated housing 12 configured and dimensioned to be gripped by a user's hand. Elongated housing 12 has a receiving compartment 14 for housing a power source 16 such as, but not limited to, an electric motor, a hydraulic pump, or a pneumatic air pump for operating pipe wrench 10. An operating switch 18 for turning power source 16 on and off is mounted on the outer surface of elongated housing 12 allowing the user to turn switch 18 on and off using his or her thumb while at the same time gripping pipe wrench 10.

Pipe wrench 10 further includes a support structure 20 substantially surrounding the outer surface of housing 12 and having a rectangular shape and including a pair of sidewalls 22, a first end wall 24, a second end wall 26, and a top surface 30 defining a receiving area 28 therewithin. Receiving area 28 houses a drive mechanism 25 such as, but not limited to, a gear assembly. Such gear assembly is commonly known in the art, and for example, is described in U.S. Pat. No. 4,178,817 issued to Gibson on Dec. 18, 1979, which is incorporated by reference herein. Support structure 20 is connected to elongated housing 12 at first end wall 24 through which power source 16 operably connects to the gear assembly.

Sidewalls 22 extend peripherally beyond the outer surface of housing 12 and above top surface 30 of support structure 20, and define a channel 32 which extends in the direction of the housing axis 23 from second end wall 26 to first end wall 24 between top surface 30 and inner faces of sidewalls 22.

A plurality of apertures 34 are disposed in a line on each sidewall 22 in the direction of axis 23. Each aperture 34 on one sidewall 22 is mirrored and aligned with a corresponding aperture 34 on the opposing sidewall 22. Each aperture 34 is disposed slightly above top surface 30 and is configured and dimensioned to receive a mounting pin 36 having sufficient length to extend from one aperture 34 on one sidewall 22 to the corresponding mirrored aperture on the opposing sidewall 22. As will be described herein, mounting pin 36 removably mounts a retaining arm 38 to support structure 20. Mounting pin 36 is preferably configured and dimensioned to be frictionally fitted within aperture 34, or alternatively, may be threaded at its opposing ends for receiving a bolt (not shown) to secure the mounting pin to the support structure.

Support structure 20 further includes an extension piece 40 extending outwardly from second end wall 26. Extension piece 40 mounts and supports a rotating shaft 42. Extension piece 40 is integral with support structure second end wall 26 at one end and includes a shaft-receiving aperture 44 extending the width of extension piece 40. Shaft-receiving aperture 44 is configured and dimensioned to removably and operably receive a rotating bushing 45 linked with drive mechanism 25, such as the gear assembly described in the Gibson patent mentioned above. Rotating shaft 42, preferably having a square cross section, is secured through rotating bushing 45 and is rotatable with the bushing in both clockwise and counter clockwise directions.

Figure 4:
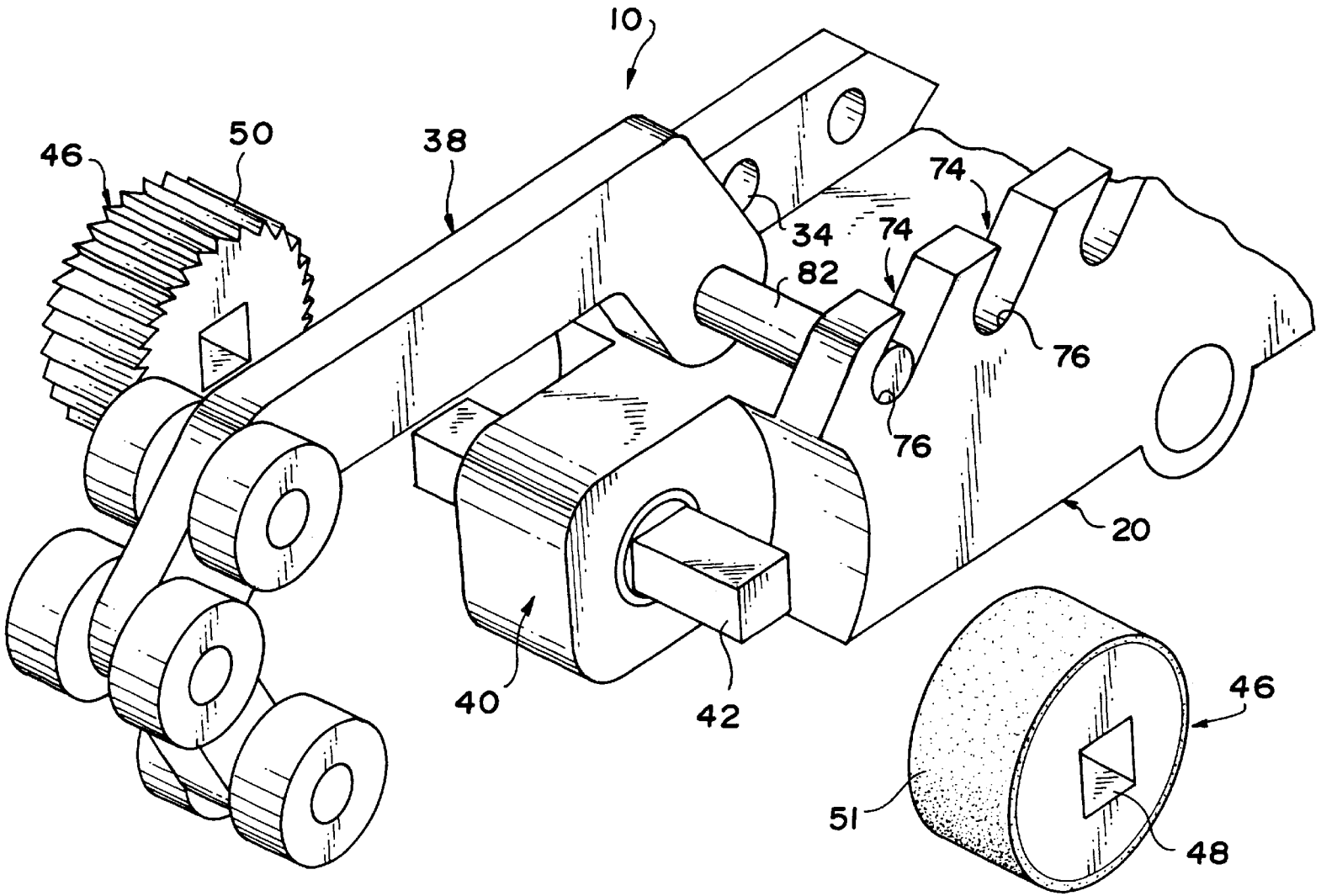
FIG. 4 is an exploded perspective view of a second embodiment of the present invention; and, FIG. 5 is a perspective view of a roller having embedded diamond chips for use with the wrench of the present invention.
Figure 5:
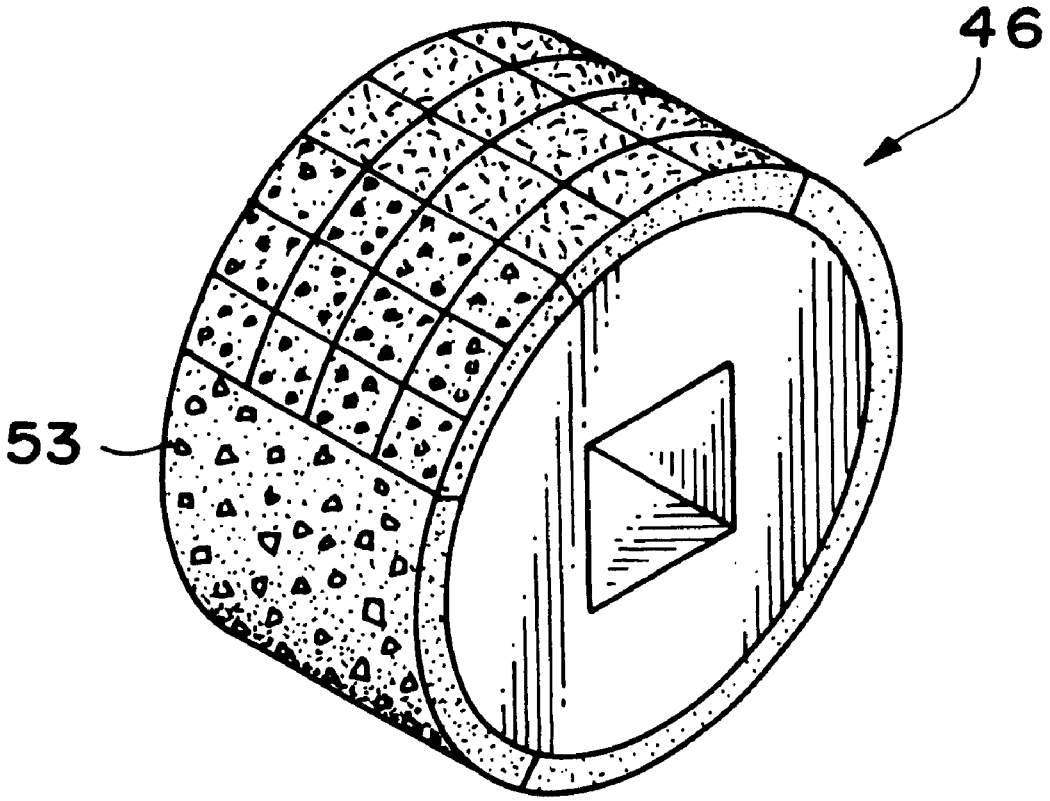

A pair of drive rollers 46 are removably mounted on opposite ends of rotating shaft 42. Each drive roller 46 has a square axial bore 48 which matches with the square cross sectional shape of rotating shaft 42. One advantage of having an non-circular bore is to provide a non-slip engagement between drive rollers 46 and bushing 45. Each drive roller 46 includes an outer toothed surface 50 for a better frictional contact with the outer surface of the pipe. Alternatively, each drive roller 46 may have a rubber outer surface 51 allowing the wrench to be safely used on different types of pipes, such as PVC pipes. A roller with a rubber outer surface is shown in FIG. 4. An alternate roller with a rubber or elastomeric surface impregnated with diamond chips 53 is shown in FIG. 5. These rollers snap on and off shaft 42 and can be changed quickly to match pipe material. Other types of rollers suited for other types of pipes could also be used. It should also be appreciated that the removable nature drive rollers 46 allows for access and cleaning of the dust and dirt build up around the rollers and the shaft Each drive roller 46 may also include a torque limiting clutch which can limit the amount of torque produced by the drive rollers. Such torque limiting clutches are well known from the torque wrench art and will not be described further herein.

Figure 2:
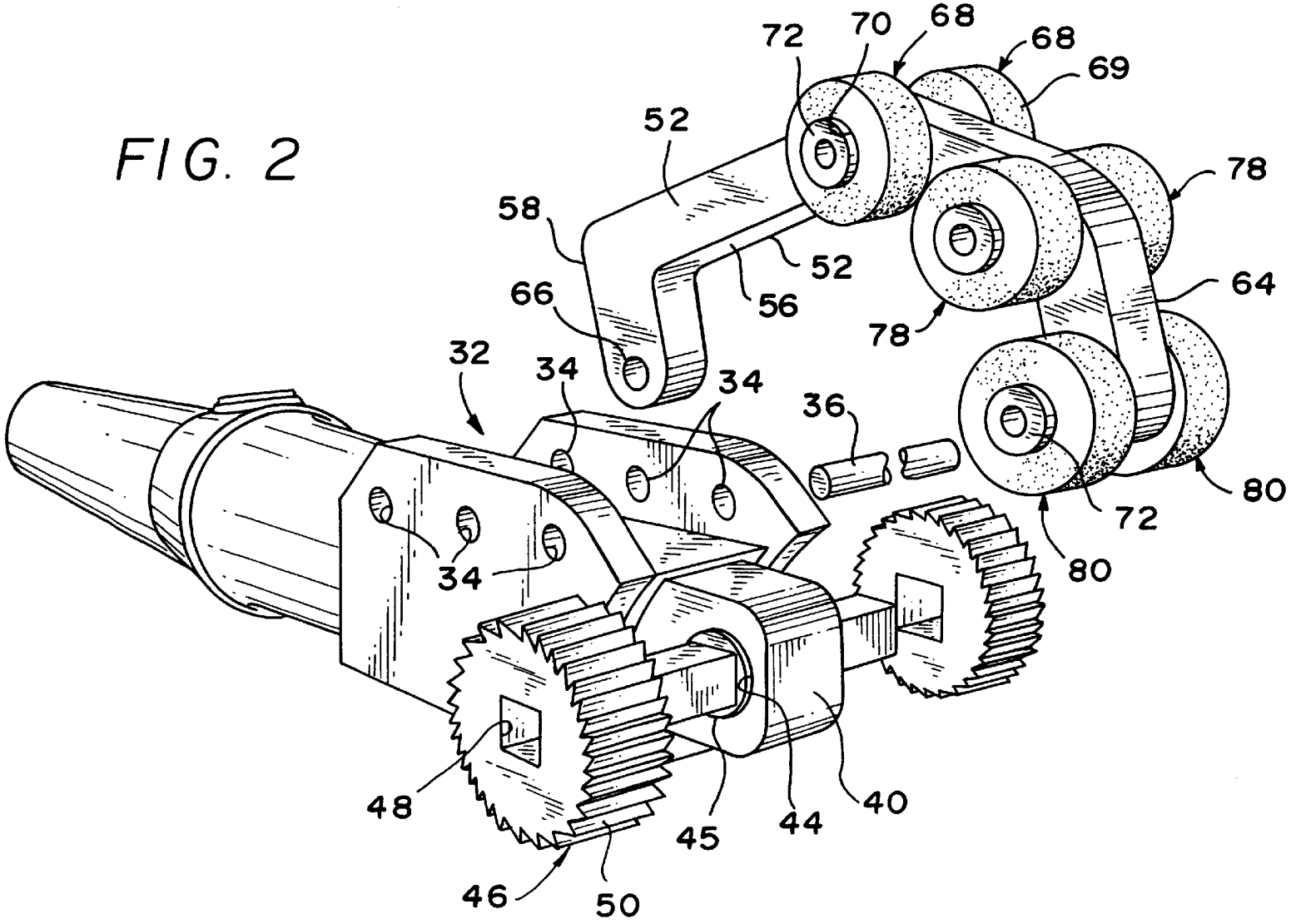
FIG. 2 is an exploded perspective view of the pipe wrench of FIG. 1 illustrating different structural components of the wrench.

Referring now to FIG. 2, retaining arm 38 has a hook-shape configuration and is preferably manufactured from steel having a rectangular cross section with a pair of side walls 52, a top wall 54, and a bottom wall 56. Retaining arm 38 further includes a first portion 58, a second portion 60 extending from first portion 58 at an angle, preferably 90 degrees, a third portion 62 extending from the end of second portion 60 at an obtuse angle, and a fourth portion 64 extending from the end of third portion 62, also at an obtuse angle. The portions are integral with one another and together form the hook-shaped retaining arm 38.

First portion 58 of the retaining arm includes an aperture 66 for receiving mounting pin 36 which extends between sidewalls 22. Retaining arm 38 pivotally mounts on support structure 20 through mounting pin 36 where it can pivot in first or second directions about mounting pin 36.

Figure 3:
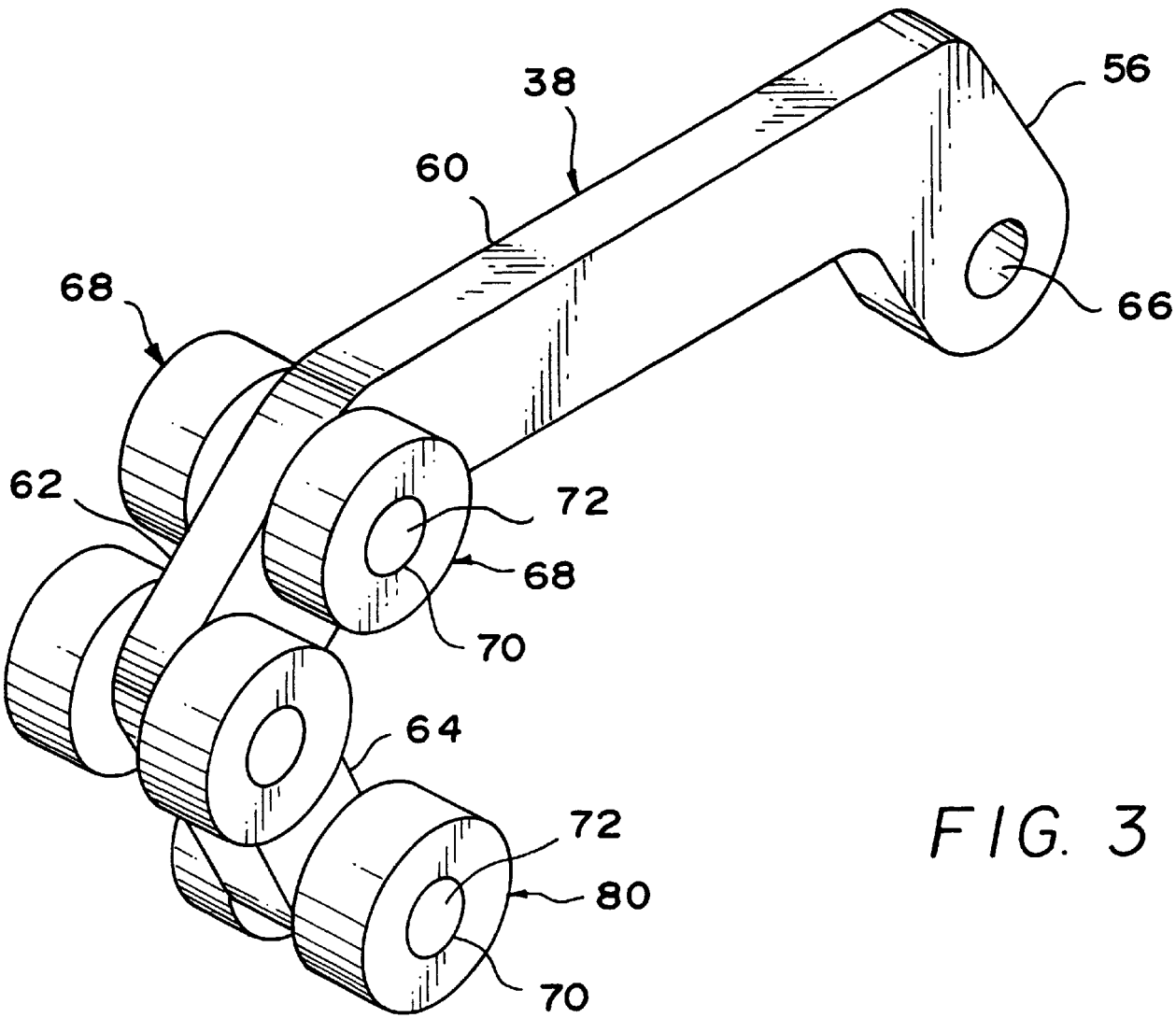
FIG. 3 is a perspective view of the retaining arm of the pipe wrench of FIG. 1.

FIG. 3 shows retaining arm 38 and a plurality of free spinning rollers that are mounted thereon. More specifically, a first pair of free spinning rollers 68 is rotatably mounted on each side 52 of arm 38 preferably at the angled connection point of second portion 60 with third portion 62 of the retaining arm. Similarly, a second pair of free spinning rollers 78 is mounted on opposing sides 52 of the retaining arm at the angled connection point of third portion 62 with fourth portion 64 of retaining arm 38, and a third pair of free spinning rollers 80 is mounted on opposing sides 52 of the retaining arm at the end of fourth portion 64 of retaining arm 38. It should be noted that a greater or lesser number of pairs of free spinning rollers could also be used without exceeding the scope of the present invention. It should further be appreciated that disposing the free spinning rollers in such configuration, i.e. at the angled connection points of each portion of the retaining arm, will allow the three pair sets of free spinning rollers to have good contact with, and therefore a better grip on pipes having a circular cross section, or other types of structures such as nuts, pipe fittings and the like. Furthermore, because the free spinning rollers are mounted on the outer portion of arm 38, they are less likely to become jammed with dirt and other materials than are the interiorly mounted rollers known from the prior art. Each of the free spinning rollers includes a spindle 72 connected to the retaining arm, an outer portion 69 preferably made out of rubber or a similar material and a bore 70 for receiving spindle 72.

The gripping diameter of retaining arm 38 with respect to drive rollers 46 is adjusted by mounting the arm on different aperture 34 locations. This is done by removing retaining pin 36 from aperture 66, moving the arm along the channel 32 and aligning aperture 66 on first portion 58 with the opposing pin receiving apertures 34 on each sidewall 22. Mounting pin 36 is then inserted through one aperture 34 on one sidewall 22 and is extended through aperture 66 and the opposing aperture thereby pivotally mounting retaining arm 38 on support structure 20.

A range of pipe diameters can be accommodated by the subject pipe wrench when the arm is mounted in each of apertures 34. This is because arm 38 rotates about mounting pin 36 to change the distance between the free spinning rollers and drive rollers 46. There is some overlap between the diameters of pipe that can be accommodated when the pin is in adjacent apertures 34, which allows the wrench to be used on pipes having a continuous range of diameters.

The operation of the subject pipe wrench to rotate a given pipe will now be described. First, retaining arm 38 is attached to support structure 20 between sidewalls 22 at a location that will allow the pipe to fit between the free-spinning rollers and the drive rollers. If the space between the free spinning rollers and the drive rollers is too large or too small, the retaining arm is repositioned in a different set of apertures as necessary. Retaining arm 38 is then placed around the pipe with the free spinning rollers in contact with the pipe and held in place while the wrench housing is pivoted about connecting pin 36 to bring pipe drive rollers 46 in contact with the pipe. It should be appreciated that the resiliency of rubber type material of each outer portion 69 allows for a slight compression of the material. This slight compression helps third pair of free spinning rollers 80 mounted at the end of fourth portion 64 of retaining arm 38 to roll over the pipe as retaining arm 38 pivots to grip the pipe against drive rollers 46.

With the pipe firmly gripped between free spinning rollers 68 and the outer toothed surface 50 of drive rollers 46, operating switch 18 is moved to actuate the power source which runs the drive mechanism to turn drive rollers 46 and rotate the pipe.

Referring now to FIG. 4, a second embodiment of pipe wrench 10 is illustrated. Elements common to the both embodiments are identified with the same reference numerals. In this embodiment, one sidewall 22 of support structure 20 includes a plurality of notches 74 inclined away from retaining arm 38 and each notch 74 is aligned with a corresponding aperture 34 in the other sidewall. A shaft 82 is attached inside aperture 66 of first portion 58 of retaining arm 38. Therefore, the retaining arm and the shaft are integral as one unit.

In this embodiment, retaining arm 38 is pivotally mounted on support structure 20 by inserting one end of shaft 82 inside one aperture 34, and placing the other end of shaft 82 inside corresponding notch 74 until the shaft rests on an arcuate surface 76 at the bottom of the notch. The gripping diameter of retaining arm 38 can be adjusted by placing the shaft at a different notch-aperture location on the support structure. The arm pivots about as the shaft pivots within the notch and the aperture.

While preferred embodiments have been shown and described, various modifications and substitutions will become obvious to those skilled in the relevant arts upon a reading and understanding of the forgoing specification. For example, while the power source of the invention has been described as being a battery powered motor, a pneumatic or other device could be used to rotate the pipe engaging rollers without departing from the scope of this invention. Applicant intends that all such obvious modifications and additions be protected to the extent that they are defined by the several claims appended hereto.

What is claimed is:

1. A pipe wrench, comprising:

a housing;

a power source disposed within said housing;

a support structure having a first end and a second end, said support structure first end being connected to said housing;

a drive mechanism disposed within said support structure, said drive mechanism operably connected to said power source;

a rotating shaft having first and second ends and being operably connected to said drive mechanism;

first and second pipe engaging drive rollers removably mounted on said first and second ends;

a retaining arm pivotally mounted on said support structure; and, a plurality of free spinning rollers mounted on said retaining arm, whereby, a pipe secured between said free spinning rollers of said retaining arm and said pipe engaging drive rollers rotates as the power source rotates said pipe engaging drive rollers through said drive mechanism.

2. The pipe wrench according to claim 1 wherein said retaining arm further comprises:

a plurality of structural portions connected to one another in a hook-shape configuration having a first end, said first end having a pin receiving aperture; and a mounting pin extending through one of said first apertures, through said pin receiving aperture and through one of said second apertures thereby pivotally securing said retaining arm to said support structure.

3. The pipe wrench according to claim 1 wherein each of said plurality of drive rollers comprises a toothed outer surface.

4. The pipe wrench according to claim 1 wherein each of said plurality of drive rollers comprises a rubber outer surface.

5. The pipe wrench according to claim 1 wherein each of said plurality of drive rollers comprises a diamond chip impregnated outer surface.

6. The pipe wrench according to claim 1 wherein said power source is an electrical motor.

7. The pipe wrench according to claim 6 wherein said drive mechanism is a gear assembly operably connecting said power source to said drive rollers.

8. The pipe wrench according to claim 1 wherein each of said plurality of free spinning rollers further comprise:

a spindle; and a rubber circular portion having a bore, said rubber circular portion mounted on said spindle.

9. A pipe wrench, comprising:

a housing;

a power source disposed within said housing;

a support structure having a first end and a second end, said support structure first end being connected to said housing;

a drive mechanism disposed within said support structure, said drive mechanism operably connected to said power source;

a rotating shaft having first and second ends and being operably connected to said drive mechanism;

first and second drive rollers removably mounted on said first and second ends;

a retaining arm pivotally mounted on said support structure; and, a plurality of free spinning rollers mounted on said retaining arm, whereby, a pipe secured between said free spinning rollers of said retaining arm and said drive rollers rotates as the power source rotates said drive rollers through said drive mechanism, wherein said support structure further comprises:

a top wall;

a first and a second opposed sidewall extending peripherally beyond said top wall;

a plurality of first apertures disposed in a line along said first sidewall; and a plurality of second apertures disposed along said opposing second sidewall and aligned with said plurality of first apertures.

10. The pipe wrench according to claim 9 wherein said support structure further comprises:

an extension piece integral with said support structure at said support structure second end, said rotating shaft mounted on said extension piece, said shaft being operably connected to said drive mechanism.

11. A pipe wrench, comprising:

a housing;

an electric motor disposed within said housing;

a support structure having a first end, a second end, a top surface, a pair of opposing first and second sidewalls extending peripherally beyond said top surface, said support structure first end being connected to said housing;

a plurality of apertures disposed in a line along said first sidewall;

a plurality of notches disposed along said opposing second sidewall and aligned with said plurality of apertures along said first sidewall;

a gear assembly disposed within said support structure and operably connected to said power source;

a rotating shaft having first and second opposed ends and being operably connected to said drive mechanism;

first and second drive rollers removably mounted on said first and second opposed ends;

a retaining arm pivotally mounted on said support structure; and, a plurality of free spinning rollers mounted on said retaining arm.

* * * * *